US006810841B1

(12) United States Patent
Peterson et al.

(10) Patent No.: US 6,810,841 B1
(45) Date of Patent: Nov. 2, 2004

(54) ELECTRONIC VALVE ACTUATOR CONTROL SYSTEM AND METHOD

(75) Inventors: Katherine Peterson, Ann Arbor, MI (US); Yan Wang, Ann Arbor, MI (US); Thomas Megli, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/641,882

(22) Filed: Aug. 16, 2003

(51) Int. Cl.[7] ..... F01L 9/04

(52) U.S. Cl. ..... 123/90.11; 251/129.01; 251/129.05

(58) Field of Search ..... 123/90.11; 251/129.01, 251/129.02, 129.16, 129.18, 129.04, 129.05; 701/114

(56) References Cited

U.S. PATENT DOCUMENTS 4,957,074 A 9/1990 Weissler, II et al.
5,119,773 A 6/1992 Schon et al.
5,917,692 A 6/1999 Schmitz et al.
5,964,192 A * 10/1999 Ishii ..... 123/90.11
6,141,201 A 10/2000 Schmitz
6,325,028 B1 12/2001 Albanello et al.
6,390,039 B2 5/2002 Fuwa
6,397,797 B1 6/2002 Kolmanovsky et al.
6,476,599 B1 * 11/2002 Czimmek et al. ..... 324/207.16
6,588,385 B2 7/2003 Fuwa
6,701,876 B2 * 3/2004 Youqing ..... 123/90.11

OTHER PUBLICATIONS

Wolfgang Hoffmann and Anna G. Stefanopoulou, Valve Position Tracking for Soft Landing of Electromechanical Camless Valvetrain, 3rd IFAC Workshop, Advances in Automotive Control Preprints, vol. 1, IFAC, Karisruhe, Germany, Mar. 28–30, 2001.

S. Butzmann, J. Melbert and A. Koch, Sensorless Control of Electromagnetic Actuators for Variable Valve Train, SAE paper 2000–01–1225, Siemens.

* cited by examiner

*Primary Examiner*—Thomas Denion
*Assistant Examiner*—Ching Chang

(57) ABSTRACT

A method and system for controlling a valve of an internal combustion engine. The system includes an electromagnet actuator having a coil and an armature magnetically coupled to the coil. The armature is coupled to the valve to stroke the valve between an open and closed position in response to a drive signal fed to the coil. The system produces an error signal as a function of a difference between a predetermined desired position time history (i.e., position trajectory), $y_d$, for the armature for each stroke of the armature and the actual position trajectory of the armature, y, during such stroke. The error signal is used to produce a feedforward command signal to a feedfoward controller for use in providing the drive signal to the coil during a subsequent stroke. The response of the feedforward controller to the error signal in providing the drive signal is an inverse function of the relationship between a change in armature position in response to a change in the drive signal.

15 Claims, 5 Drawing Sheets

ELECTRONIC VALVE ACTUATOR CONTROL SYSTEM AND METHOD

TECHNICAL FIELD

This invention relates generally to electronic valve actuator (EVA) control systems and methods more particularly to EVA control systems and methods for reducing valve impact.

BACKGROUND

As is known in the art, one common approach to electronically control the valve actuation of an internal combustion engine is to have two electromagnets toggle an armature coupled to the valve between an open position and a closed position. More particularly, referring to FIG. 2A, when a first, here upper, one of the electromagnets is activated, the armature is attracted to the activated electromagnet thereby driving the valve to its closed position. Also, as the armature is attracted to the activated electromagnet, a first spring, in contact with the upper end of the armature is compressed. When the first electromagnet is deactivated, the first compressed spring releases it stored energy and drives the armature downward thereby driving the valve towards it open position. As the armature approaches the second, lower electromagnet, the second electromagnet is activated driving the valve to its full open position. It is noted that a second, lower spring becomes compressed during the process, i.e., during capture of the armature by the activation of the second electromagnet). After being fully open for the desired period of time, the second electromagnet is deactivated, and the lower spring releases its stored energy and thereby drives the armature towards its upper position, the first electromagnet is activated and the process repeats. Thus, the two electromagnets toggle the armature couples to the valve between an open or closed position where it is held, while the pair of springs is used to force the valve to move (oscillate) to the other state (FIG. 2B).

One problem with the approach described above is that, it suffers from large impacts at several different locations due to the motion of the armature and valve. These impacts may be excessively loud and may lead to actuator failure. One technique suggested to control the position trajectory of the armature during "capture" is described in a paper entitled "Valve Position Tracking For Soft Landing of Electromechanical Camless Valvetrain", by Wolfgang Hoffman and Anna G. Stefanopoulu, published in the 3rd IFAC Workshop Advanced Automotive Control Preprints Volume I, Karisruhe, Germany Mar. 28–30, 2001. The technique described therein includes the use of a feedback controller having an observer used to stabilize the system at an equilibrium point close to the armature capture point. The observer provides estimates of the magnetic flux produced by the coil and the velocity of the armature. Of particular interest to this invention are the impacts which occur between the armature and valve stem during the release of the armature.

More particularly, the armature is in contact with the valve and its motion forces the valve to open or close. The contact velocity between the armature and valve stem during release of the armature needs to be reduced to an acceptable level (below 0.4 m/s for the engine RPM range of 700 to 6000) to avoid excessive noise and wear. The contact velocity has to be maintained within this range robustly, i.e., despite varying ambient conditions and changes in engine speed, load, temperature and power supply voltage that can occur in the course of normal engine operation. In addition, excessive power consumption is to be avoided to maximize fuel economy and avoid over-heating of the actuator coils.

SUMMARY

In accordance with the present invention a system is provided for controlling a valve of an internal combustion engine. The system includes an electromagnet actuator having a coil and an armature magnetically coupled to the coil. The armature is coupled to the valve to stroke the valve between an open and closed position in response to a drive signal fed to the coil. The system produces an error signal as a function of a difference between a predetermined desired position time history (i.e., position trajectory), $y_d$, for the armature for each stroke of the armature and the actual position trajectory of the armature, y, during such stroke. The error signal is used to produce a feedforward command signal to a feedfoward controller for use in providing the drive signal to the coil during a subsequent stroke. The response of the feedforward controller to the error signal in providing the drive signal is an inverse function the relationship between a change in armature position in response to a change in the drive signal.

In one embodiment, the feedfoward controller may be represented as:

$$U_{controller}=y_r[n,k+1]+[\{(di_d/dt-i_d dy/dt)/(k_b+y_d)\}/(2k_a)/(k_b+y_d)]+ri_d$$

where:

- $U_{controller}$ is the control signal fed to the coil of the electromagnetic;
- $y_r[k+1]$ is the feedforward command signal for the subsequent stroke;
- $y_r[k]$ is the produced feedforward command signal;
- $y_d$ is the desired position trajectory; and
- r is the electrical resistance of the of the electromagnetic coil
- $k_a$ and $k_b$ are constants determined by the magnetic properties of the electromagnetic coil
- $i_d$ is the theoretical current that would cause the armature to track $y_d$ and is given by:

$$i_d = \sqrt{\frac{k_s(l-y_d)+k_{pre}}{k_a}}\,(k_b+y_d)$$

where:

- $k_s$ is the stiffness of a spring used to initiate the motion of the armature in response to removal of the drive signal;
- $k_{pre}$ is the preload of the spring in the actuator spring used to initiate the motion of the armature in response to removal of the drive signal;
- l is one-half the total travel of the armature.

That is, representing y as being equal to a function, fnc of ($u_{controller}$), i.e., fnc($u_{controller}$), the feedfoward controller 400 may be represented as a function which is $fnc^{-1}$ (i.e., the inverse of the function fnc). Or, to put it another way, the feedforward control is $fnc^{-1}$, where: $fnc^{-1}$ is the inverse of the function relating the position of the armature to drive signal to the armature.

In one embodiment, the feedforward controller is used to modify the drive signal only during a second phase of the valve stroke; in the first, or initial, release phase, the release valve is controlled by the predetermined drive signal. During release of the armature this predetermined drive signal is used to ensure that the current in the coil being presently used to hold the armature is sufficiently reduced as to initiate motion of the armature.

In accordance with another feature of the invention, a method is provided for controlling a valve of an internal combustion engine system having an electromagnet with an armature magnetically coupled to a coil of such electromagnet. The armature is coupled to the valve. The armature strokes the valve between an open and closed position in response to a drive signal fed to the coil. The method includes providing an open-loop, pre-set control signal to the coil, such signal being representative of a desired position trajectory for the armature for each stroke of the armature. The pre-set control signal is maintained at a pre-set level during an initial phase. Subsequent to the initial phase, the feedforward control system is used to generate the drive signal to the coil to drive the armature such that the armature and valve collide at low contact velocities. A cycle-to-cycle (i.e., stroke-to-stroke) adjustment is made of the feedforward command signal to adjust for better tracking of the desired position trajectory; this adjustment mechanism is referred to as an iterative learning control (ILC) mechanism.

The desired position time history (i.e., trajectory) is designed to provide a desired low impact velocity between the armature and valve stem. In general, the desired position trajectory cannot be followed exactly due to the system dynamics or unknown disturbances. To account for all of these difficulties, the ILC modifies the commanded feedforward command signal so that the actual armature position trajectory follows the desired position trajectory during release of the armature.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
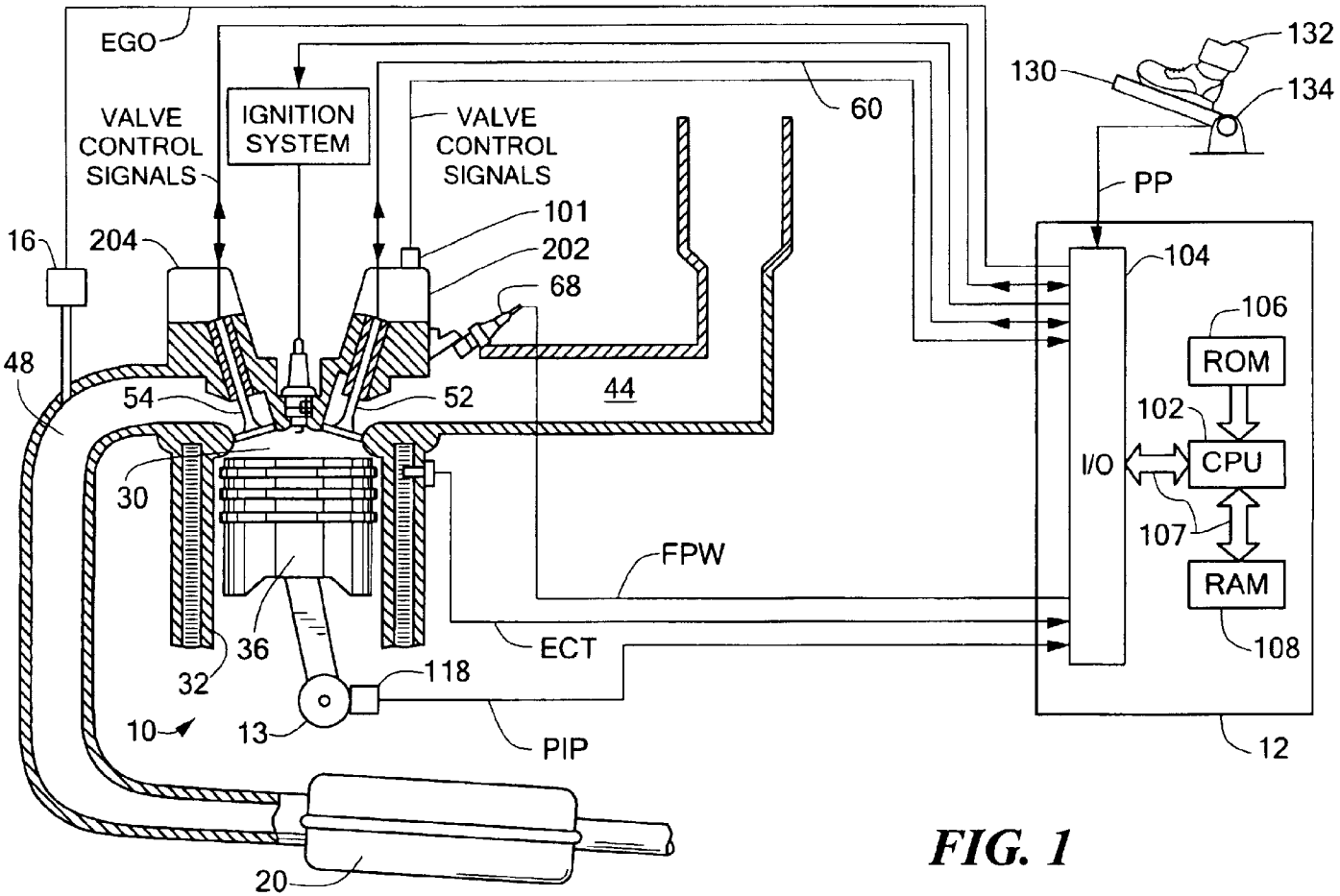
FIG. 1 is a block diagram of an engine system having an electronically controlled valves system according to the invention.

Referring now to FIG. 1, a simplified block diagram of a camless internal combustion engine 10 is shown using a valve control method and system in accordance with the present invention. The engine 10 includes a plurality of cylinders (only one shown) each having a combustion chamber 30 and cylinder walls 32 in cooperation with piston 36 positioned therein and coupled to a crankshaft 13. The combustion chamber 30 communicates with corresponding intake and exhaust manifolds 44 and 48, respectively, via intake and exhaust valves 52 and 54. The intake and exhaust valves 52 and 54 are actuated via corresponding electromechanical or electromagnetic actuators 202 and 204, respectively. An exemplary one, here exhaust valve 52 is shown in FIGS. 2A and 2B.

Figure 2B:
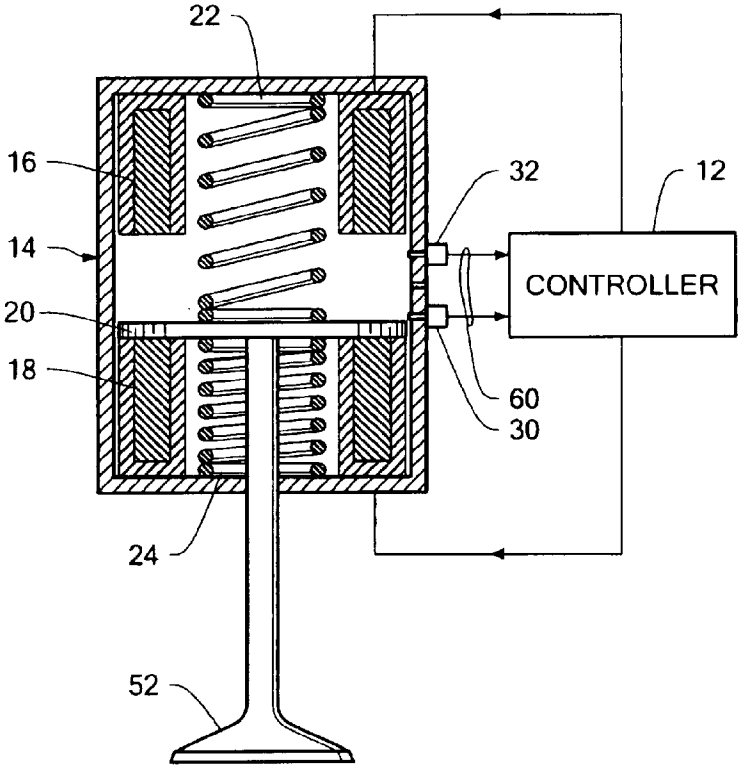
FIGS. 2A and 2B are diagrammatically sketches shown a valve actuation system according to the invention, such FIGS. showing the valve in an open position and a closed position, respectively.
Figure 2A:
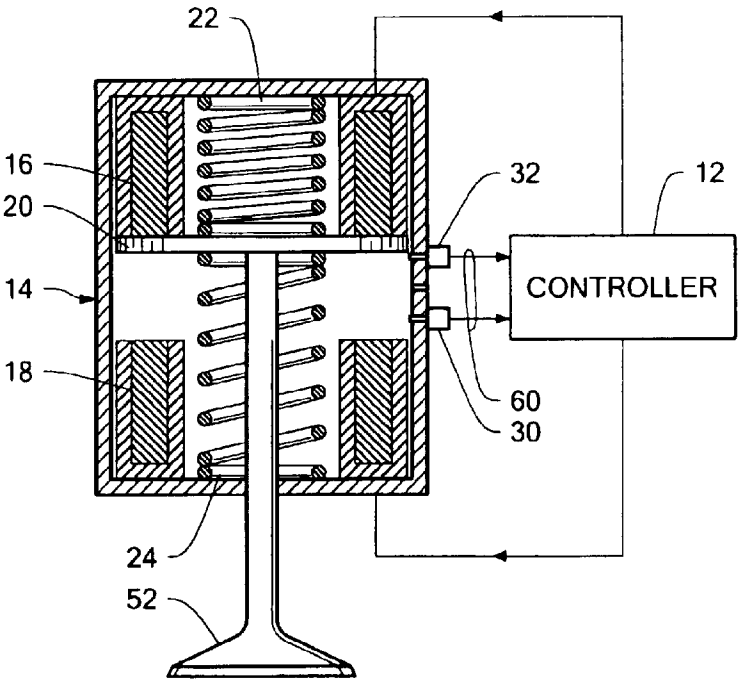

Thus, referring to FIGS. 2A and 2B, a diagrammatic sketch is shown wherein valve control signals on bus 60 control movement of a valve 52 in a camless engine between a fully closed position (shown in FIG. 2A), and a fully open position (shown in FIG. 2B). The position of valve 52 is controlled by a valve actuator which includes an electromagnetic valve actuator (EVA) 14 with upper and lower coils 16,18 which electromagnetically drive an armature 20 against the force of upper and lower springs 22,24 for controlling movement of the valve 52

Position sensors 30, 32 are provided to produce an electronic signal in response to the position of the armature 20 relative to the fixed coils 16, 18. The controller 12 is operatively connected to the position sensors 30, 32, and to the upper and lower coils 16,18 in order to control actuation and landing of the valve 12.

It is noted that the engine controller 12 also receives various signals from sensors coupled to engine 10, the sensors including but not limited to: a temperature sensor 112 coupled to cooling jacket 114 for measuring engine coolant temperature (ECT); a pedal position sensor 134 for providing the accelerator pedal 130 position (PP) as commanded by the driver 132; and an engine position sensor 118 coupled to crankshaft 13 for indicating the operating speed (N) of the camless internal combustion engine. Preferably, the engine controller 12 includes a microprocessor unit 102, input/output ports 104, random access memory (RAM) 108, read-only memory (ROM) 106 and a data bus 107. The RAM and ROM are here semiconductor chips. Here ROM 106 stored a computer program, to be described, for providing control signals to the coils 22, 24 in a manner to be described herein after. Suffice it to say here that based at least in part on position signals produced by sensors 32, 34 the engine controller 12 drives one or more coils to actuate the valves.

Referring again to FIGS. 2A and 2B, the valve motion is governed through the forcing of the armature by the opposing sets of electromagnets and springs. A typical operation begins with the armature held against either the upper or lower magnetic coil 16, 18. This creates an imbalance between the opposing springs 22, 24 which will drive the armature 20 across the gap between the coils 16, 18 when the current in the releasing coil 16, 18 is sufficiently reduced. As the armature 20 nears the opposite side, it is caught by and held against the remaining electromagnetic coil 18, 16 to complete the transition, or stroke. Once again an imbalance is created in the opposing springs 22, 24 which is used to reverse the process. The spring forces are balanced when the armature 20 is equidistant from each magnetic coil 16, 18 as described in U. S. Pat. No. 6,397,797 issued Jun. 4, 2002, inventors Kolmanovsky et al. assigned to the same assignee as the present invention.

Figure 3:
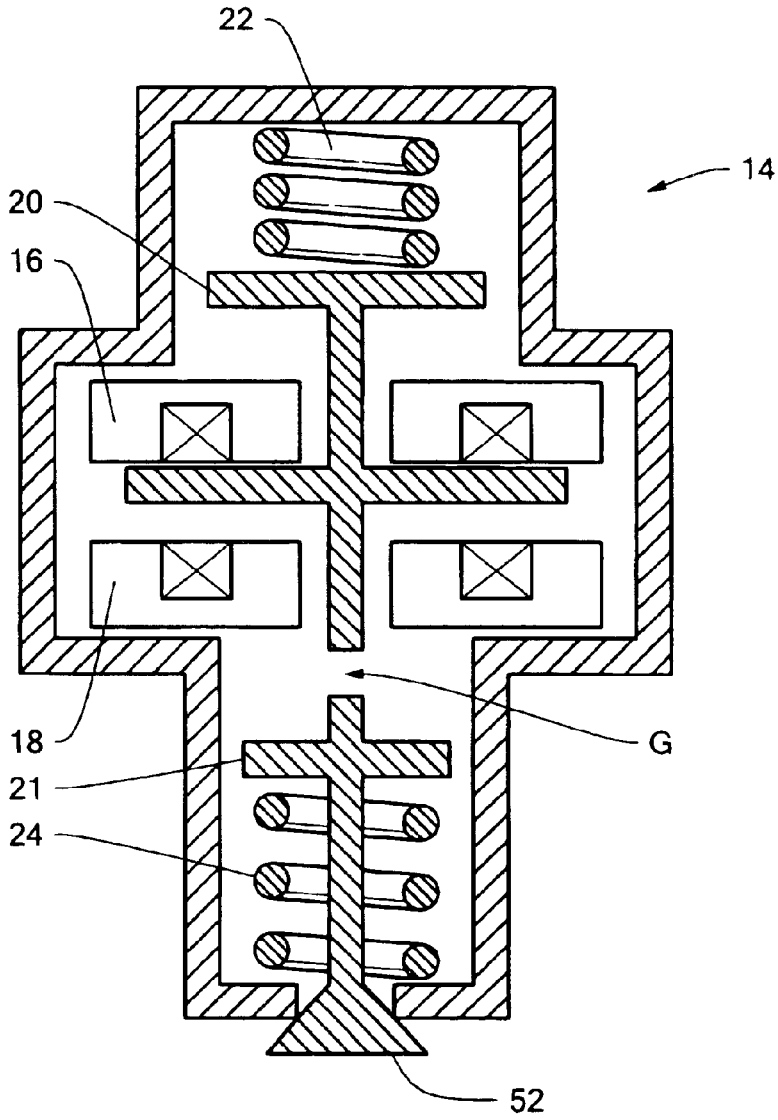
FIG. 3 is a simplified sketch of a valve actuator used in the system if FIG. 1.

Referring now to FIG. 3, a more detailed sketch is shown of the electromagnet actuator 14 shown diagrammatically in FIGS. 2A and 2B. It is noted that, as in conventional cam driven systems, the valves 52 are not physically connected to the armature 20 in order to allow for thermal expansion during operation. This ensures that the valve 52 will always close against the valve seat, not shown. The gap G between the armature 20 and valve stem 21 is denoted as the valve lash and can range between 0.1 mm to 0.5 mm depending on the thermal expansion of the valve. In a conventional cam system a physical device referred to as a lash adjuster, is used to account for the valve lash and avoid large impacts between the valve and the cam. Rather than redesign the actuator to include a similar device, which would increase packaging size and cost, the existing hardware can, in accordance with the invention, be utilized to achieve the desired performance.

Figure 4:
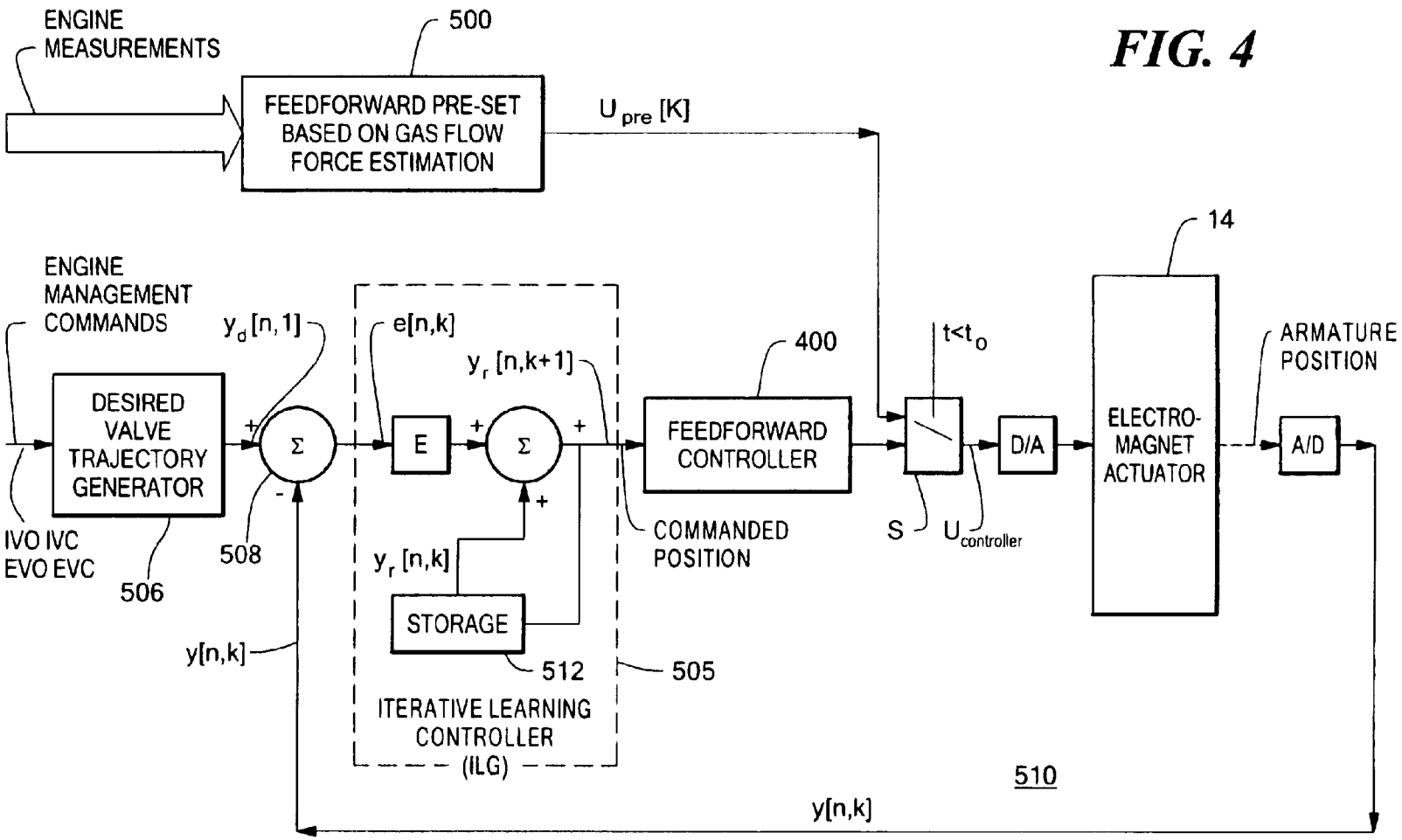
FIG. 4 is a block diagram of an iterative learning controller used in controlling the release of the armature.
Figure 5:
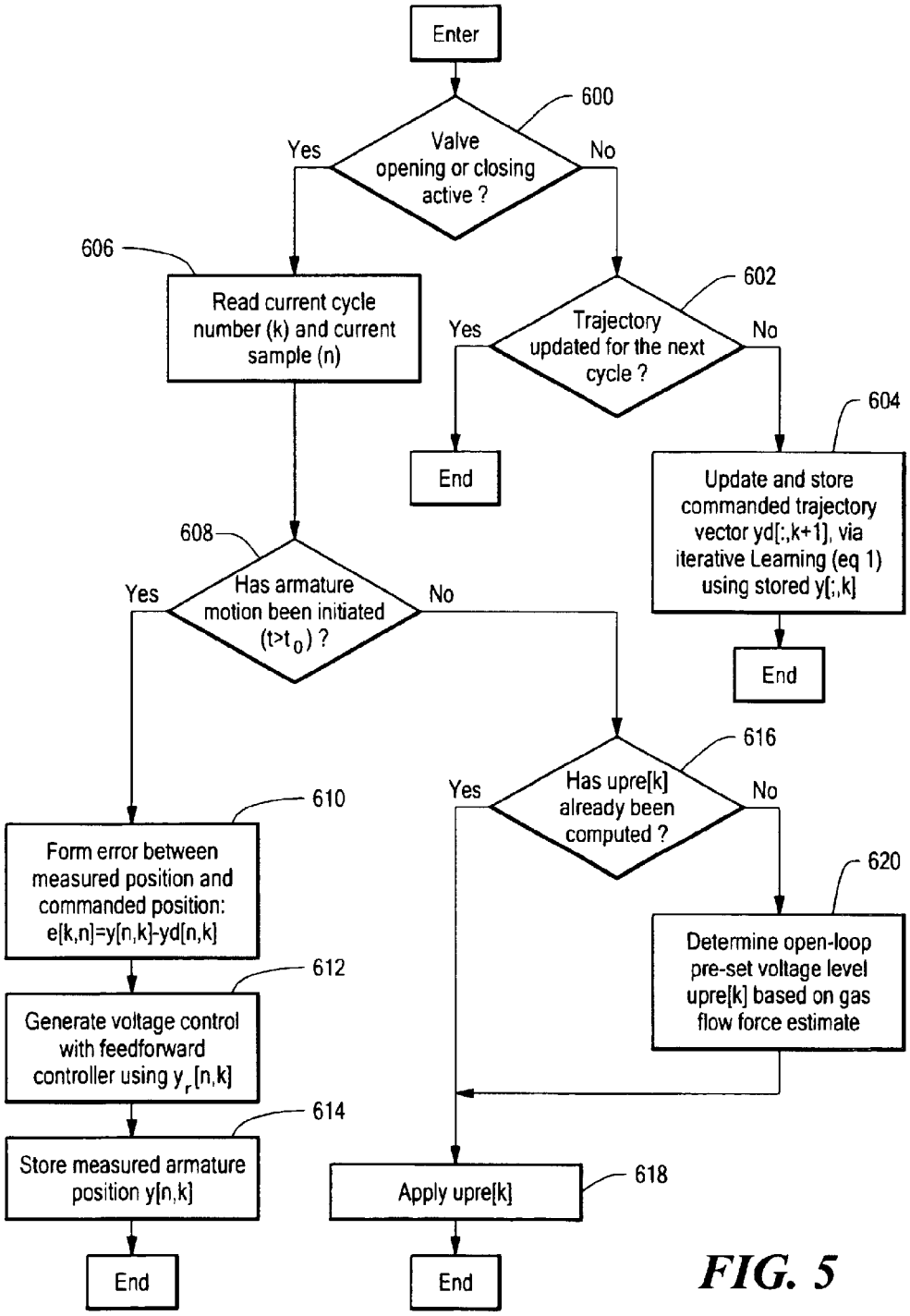
FIG. 5 is a flow diagram of the process used by the iterative learning controller of FIG. 4 according to the invention.

Referring now to FIG. 4, a block diagram is shown of a feedback control system implemented in software and represented by the flow diagram in FIG. 5 for release of the armature 20 (FIG. 3). It should be also noted that the flow diagram is representative of a computer program stored, as noted above, in the ROM 106 of FIG. 1.

Briefly, and referring to FIG. 4, three main ingredients of the process includes:

The use of open-loop pre-set controls wherein the voltage, $u_{pre}[k]$ applied to the actuator coil being presently used to hold the armature in place is used to reduce the magnetic force produced by said coil to less than the spring force and gas flow force acting on the armature in order to initiate motion of the armature. A measure of the gas force is provided to the controller by a higher-level engine management unit 500 based on the operating conditions of the engine;

The use of a feedforward controller 400 is used as part of a feedback control system 510 to provide the signal $u_{controller}$ for the armature coil of actuator 14 via a switch, S, after the pre-set phase of control ends and is designed to generate voltage in the coil which was previously being used to hold the armature in order to control a portion of the initial armature motion. The time at which this feed forward command is turned on is designated $t_0$; and The use of a cycle-to-cycle (i.e., armature stroke to stroke) adjustment of the signal fed to the feedforward controller 400 to adjust for better tracking of the position trajectory provided by an iterative learning controller (ILC) 505 to be described below. Suffice it to say here, however, that the iterative learning controller (ILC) 505 provides the mechanism used to provide cycle-to-cycle (i.e., stroke-to-stroke) adjustment of the commanded position trajectory and pre-set duty cycle level for release of the armature. Thus, a desired valve trajectory generator 506 produces a desired armature release position trajectory, $y_d[n,k]$, where k is the stroke number and n is the sample, in response to engine command signals (i.e., for an exhaust valve: exhaust valve opening, EVO, exhaust valve closing, EVC; for an intake valve: intake valve opening, IVO, intake valve closing, IVC). A difference 508 provides an error signal e[n,k] representative of the difference between the desired valve trajectory generator 506 (i.e., the signal $y_d[n,1]$ and the armature position measurement of the current armature stroke, y[n,k]. The error signal, e[n,k], is fed to an iterative learning controller (ILC) 505. The ILC 505 produces the feedforward command signal for feedforward controller 400 for the next armature stroke, i.e., $y_r[n,k+1]$ where:

$$y_r[n,k+1]=y_r[n,k]+E^*(e\,[n,k])=y_r[n,k]+E^*(y_d-y[n,k]),$$

where E is a weighting matrix.

The weighting matrix, E, is here obtained by first obtaining a linear model by linearizing the feedback control system 510 around an equilibrium point. This linear model is then used to form a discrete impulse response matrix, P, which is lower triangular in the matrix below and whose elements consist of the discrete impulse response of the system.

Let the impulse response of the system be $$H=[h(\mathbf{0})\ h(\mathbf{1})\ h(\mathbf{2})\ \ldots\ h(N)]$$

therefore P is given by

P=[h(0) 0 0 0 . . . . ]
[h(1) h(0) 0 0 . . . ]
[(h(2) h(1) h(0) 0 0 . . . ]
[. . . ]
[h(N) h(N−1) . . . h(0)]

P can then be written as P=LDR^t where the superscript ^t signifies the transpose of the matrix. L is the left singular vectors of P, R is the right singular vectors of P and D is a diagonal matrix whose elements are the singular values of P arranged in decreasing order. E is then:

$$E=(RL\hat{\ }t)/\mathrm{sigma}(\mathbf{0})$$

where sigma(0) is the largest singular value of P.

This adjustment mechanism follows from the objective of minimizing the standard 2 norm || || expression:

$$\|y_d-y[:,k]\|$$

A storage section 512 stores the last command signal $y_r[n,k]$. The error signal, e[n,k], is multiplied by E and the product is added to the previous command, $y_r[n,k]$, to thereby produce the command signal, $y_r[n,k+1]$, for the feedforward controller 400 for the next armature stroke.

The desired position trajectory, $y_d$, is designed so that if it is followed accurately by the armature, the desired low impact velocity is achieved. In the case of armature release this refers to the impact velocity between the armature and valve stem. In general, the desired position trajectory, $y_d$, cannot be followed exactly due to the system dynamics or unknown disturbances. To account for all of these difficulties, the ILC 505 modifies the commanded reference armature position trajectory input to the feedforward control system 400 so that the actual armature position, y, follows the desired trajectory, yd. Here, for example, the desired position trajectory is $y_d=0.4*(t-t_0)$, where $y_d$ is measured in meters and where the system controls the position trajectory for the first 0.5 millimeters (mm) of the release and where the total travel of the armature is 8 mm, or approximately 6 per cent of the armature stroke.

The switch, S, is used to switch between a pre-set duty cycle voltage control, $u_{pre}[k]$, and the feedforward control system 400 signal, $y_r[n,k+1]$, such switch occurring when the armature motion has been initiated for armature release, i.e., $t=t_0$. For armature release the main reason for employing the pre-set voltage control is to initiate the armature motion. The iterative learning mechanism 505 applied also to the pre-set voltage value ensures that the pre-set voltage value changes after learning the current operating conditions from measuring the previous cycles (i.e., armature strokes).

The feedforward control system 400 is designed by directly calculating the voltage required to achieve tracking based on a model of the electromagnetic actuator. Here, the feedfoward control system may be represented as:

$$u_{controller}=y_r[n,k+1]+[\{(di_d/dt-i_d dy_d/dt)/(k_b+y_d)\}/(2k_a)/(k_b+y_d)]+ri_d$$

where r is the electrical resistance of the of the electromagnetic coil $k_a$ and $k_b$ are constants determined by the magnetic properties of the electromagnetic coil $i_d$ is the theoretical current that would cause the armature to track $y_d$ and is given by:

$$i_d = \sqrt{\frac{k_s(l - y_d) + k_{pre}}{k_a}}\,(k_b + y_d)$$

where $k_s$ is the stiffness of the spring used to initiate the motion of the armature in response to removal of the drive signal;

$k_{pre}$ is the preload of the spring used to initiate the motion of the armature in response to removal of the drive signal;

l is one-half the total travel of the armature.

That is, representing y as being equal to a function, fnc of ($u_{controller}$), i.e., fnc($u_{controller}$), the feedfoward controller 400 may be represented as a function which is $fnc^{-1}$ (i.e., the inverse of the function, fnc). Or, to put is another way, the feedforward control is $fnc^{-1}$, where: $fnc^{-1}$ is the inverse of the function relating the position of the armature to drive signal to the armature.

Thus, a storage section 512 stores the last command signal, $y_r$[n,k]. The error signal, e[n,] is multiplied by E and the product is added to the previous command $y_r$[n,k] to thereby produce the command signal, $y_r$[n, k+1], for the feedforward controller 400 for the next armature stroke. Thus, $$y_r[n,k+1]=e[n,k]*E+y_r[n.k].$$

The digital signals produced at the output of the switch, S, are converted into an analog signal be a digital-to-analog (D/A) converter. Likewise, the armature position signal is converted into a corresponding digital signal by an analog to digital (A/D) converter.

The desired position trajectory, $y_d$, is designed so that if it is followed accurately by the armature, the desired low impact velocity is achieved. For armature release this point in time is, as described above in connection with FIG. 4, designated as to. For armature release, the main reason for employing the pre-set voltage control is to initiate the armature motion.

For armature release, the control system includes a feedforward controller 400 shown in FIG. 4 to bring the armature motion near the desired release trajectory. The feedforward controller 400 is designed by directly calculating the voltage required to achieve tracking based on a model of the electromagnetic actuator.

The cycle-to-cycle (i.e., armature stroke-to-stroke) adjustment of the commanded position trajectory, $y_r$, and of the pre-set voltage level, $u_{pre}$, is accomplished by an iterative learning controller 505 based on the observed error between the position/velocity trajectory that the armature followed within the previous cycle and the desired position/velocity trajectory. This cycle-to-cycle adaptation is a critical mechanism for compensating for changes in ambient conditions and engine speed and load, in the course of normal engine operation.

Referring now to FIG. 5, in Step 600 a determination is made as to whether the armature is in either an opening or closing condition. If not, a determination is made in Step 602 as to whether the position trajectory, $y_r$, has been updated for the next cycle. Is so, the value $y_r$ is stored in memory storage 512 (FIG. 5); if not, the position command trajectory, $y_r$, is updated using equation (1) and the result is stored in storage 512, Step 604.

On the other hand, if in Step 600 it is determined that the armature is in either an opening or closing condition, a reading of the current stoke number (k) and sample n, are taken in Step 606. In Step 608, a determination is made as to whether the armature has been released, i.e., whether $t<t_0$. If is has, the process proceed to Step 610 and the error e[k,n] between the measured armature position, y[n,k], and the commanded position, $y_r$[n,k], is taken: e[k,n]=y^[n,k]−$y_d$[n, k]. Next, in Step 612 the voltage $u_{controller}$ is generated for the coil using the feedforward controller 400 in FIG. 4, i.e., $y_r$[n,k+1], and the measured armature position is stored in the storage 512 in Step 614.

However, if in Step 608, a determination is made that the armature has not been released, i.e., whether $t>t_0$, a determination is made in Step 616 as to whether $u_{pre}$[k] been computed by feedforward estimation 500 (FIG. 5). If it has, the computed $u_{pre}$[k] is applied to the actuator 14 via switch S (FIG. 5), Step 618. If not, a determination is made of the open loop pre-set voltage $u_{pre}$[k] based on gas flow force estimates, Step 620.

A number of embodiments of the invention have been described. Nevertheless, it will be understood that various modifications may be made without departing from the spirit and scope of the invention. Accordingly, other embodiments are within the scope of the following claims.

What is claimed is:

1. A system for controlling a valve of an internal combustion engine, comprising: a feedback control system, comprising:

an electromagnetic actuator comprising an electromagnet having a coil and an armature magnetically coupled to the coil, such armature being coupled to the valve to stroke the valve between an open and closed position in response to a drive signal fed to the coil;

a feedforward controller, wherein the feedback control produces an error signal as a function of a difference between a predetermined desired position trajectory for the armature for each stroke of the armature and the actual position trajectory of the armature during such stroke, such error signal being used to produce a feedforward command signal to the feedforward controller, such feedforward controller to produce the drive signal to the coil during a subsequent stroke; and wherein the response of the feedforward controller to the error signal in providing the drive signal is an inverse function of the relationship between a change in armature position in response to a change in the drive signal.

2. The system recited in claim 1 wherein, the feedfoward controller may be represented as:

$$u_{controller}=y_r[n,k+1]+[\{(di_d/dt-i_d dy_d/dt)/(k_b+y_d)\}/(2k_a)/(k_b+y_d)]+ri_d$$

where:

$u_{controller}$ is the drive signal fed to the coil of the electromagnetic;

$y_r$[k+1] is the feedforward command signal for the subsequent stroke;

$y_r$[k] is the produced feedforward command signal;

$y_d$ is the desired position trajectory; and r is the electrical resistance of the of the electromagnetic coil $k_a$ and $k_b$ are constants determined by the magnetic properties of the electromagnetic coil;

$i_d$ is the theoretical current in the coil that would cause the armature to track $y_d$ and is given by:

$$i_d = \sqrt{\frac{k_s(l - y_d) + k_{pre}}{k_a}}\,(k_b + y_d)$$

where $k_s$ is the stiffness of a spring used in the actuator to initiate the motion of the armature;

$k_{pre}$ is the preload of the spring used to initiate the motion of the armature;

l is one-half the total travel of the armature.

3. The system recited in claim 1 wherein the feedforward control is $fnc^{-1}$ where:

$fnc^{-1}$ is the inverse of the function relating the position of the armature to drive signal to the armature.

4. A method for controlling a valve of an internal combustion engine system having an electromagnet with an armature magnetically coupled to a coil of such electromagnet, such armature being coupled to the valve, such armature stoking the valve between an open and closed position in response to a drive signal fed to the coil, comprising:

providing an open-loop, pre-set control signal to the coil, such signal being representative of a desired position trajectory for the armature for each stroke of the armature, such pre-set control signal being maintained at a pre-set level during an initial phase; and subsequent to the initial phase, using a feedforward control system to generate the drive signal to the coil to drive the armature, and thereby the valve, to a fully closed or fully open position, such feedforward controller responding to a difference between a desired position trajectory for the armature and the actual position trajectory of the armature during a stroke to produce an error signal wherein the response of the feedforward controller to the error signal in providing the drive signal is an inverse function of the relationship between a change in armature position in response to a change in the drive signal; and adjusting stroke-to-stroke the feedforward command signal using an iterative learning control mechanism.

5. A system method for controlling a valve of an internal combustion engine having an electromagnetic actuator comprising an electromagnet having a coil and an armature magnetically coupled to the coil, such armature being coupled to the valve to stroke the valve between an open and closed position in response to a drive signal fed to the coil, comprising:

producing an error signal as a function of a difference between a predetermined desired position trajectory for the armature for each stroke of the armature and the actual position trajectory of the armature during such stroke, such error signal being used to produce a feedforward command signal to a feedforward controller, such feedforward controller producing the drive signal to the coil during a subsequent stroke wherein the response of the feedforward controller to the error signal in providing the drive signal is an inverse function of the relationship between a change in armature position in response to a change in the drive signal.

6. The system recited in claim 5 wherein, the feedfoward controller may be represented as:

$$u_{controller}=y_r[n,k+]+[\{(di_d/dt-i_d dy_d/dt)/(k_b+y_d)\}/(2k_a)/(k_b+y_d)]+ri_d$$

where:

$u_{controller}$ is the drive signal fed to the coil of the electromagnetic;

$y_r[k+1]$ is the feedforward command signal for the subsequent stroke;

$y_r[k]$ is the produced feedforward command signal;

$y_d$ is the desired position trajectory; and r is the electrical resistance of the of the electromagnetic coil $k_a$ and $k_b$ are constants determined by the magnetic properties of the electromagnetic coil;

$i_d$ is the theoretical current in the coil that would cause the armature to track $y_d$ and is given by:

$$i_d = \sqrt{\frac{k_s(l - y_d) + k_{pre}}{k_a}}\,(k_b + y_d)$$

where $k_s$ is the stiffness of a spring used in the actuator to initiate the motion of the armature;

$k_{pre}$ is the preload of the spring used to initiate the motion of the armature;

l is one-half the total travel of the armature.

7. The system recited in claim 6 wherein the feedforward control is $fnc^{-1}$ where:

$fnc^{-1}$ is the inverse of the function relating the position of the armature to drive signal to the armature.

8. An article of manufacture comprising:

a computer storage medium having a computer program encoded therein for controlling a valve of an internal combustion engine having an electromagnetic actuator comprising an electromagnet having a coil and an armature magnetically coupled to the coil, such armature being coupled to the valve to stroke the valve between an open and closed position in response to a drive signal fed to the coil, said computer storage medium comprising:

code for producing an error signal as a function of a difference between a predetermined desired position trajectory for the armature for each stroke of the armature and the actual position trajectory of the armature during such stroke, such error signal being used to produce a feedforward command signal to a feedforward controller, such feedforward controller producing the drive signal to the coil during a subsequent stroke wherein the response of the feedforward controller to the error signal in providing the drive signal is an inverse function of the relationship between a change in armature position in response to a change in the drive signal.

9. The article of manufacture recited in claim 8 the feedfoward controller may be represented as:

$$u_{controller}=y_r[n,k+1]+[\{(di_d/dt-i_d dy_d/dt)/(k_b+y_d)\}/(2k_a)/(k_b+y_d)]+ri_d$$

where:

$u_{controller}$ is the drive signal fed to the coil of the electromagnetic;

$y_r[k+1]$ is the feedforward command signal for the subsequent stroke;

$y_r[k]$ is the produced feedforward command signal;

$y_d$ is the desired position trajectory; and r is the electrical resistance of the of the electromagnetic coil $k_a$ and $k_b$ are constants determined by the magnetic properties of the electromagnetic coil;

$i_d$ is the theoretical current in the coil that would cause the armature to track $y_d$ and is given by:

$$i_d = \sqrt{\frac{k_s(l - y_d) + k_{pre}}{k_a}}\,(k_b + y_d)$$

where $k_s$ is the stiffness of a spring used in the actuator to initiate the motion of the armature;

$k_{pre}$ is the preload of the spring used to initiate the motion of the armature;

l is one-half the total travel of the armature.

10. The article of manufacture recited in claim 9 wherein the feedforward control is $fnc^{-1}$ where:

$fnc^{-1}$ is the inverse of the function relating the position of the armature to drive signal to the armature.

11. The article of manufacture recited in claim 8 wherein the storage medium is a semiconductor chip.

12. A system for controlling a valve of an internal combustion engine, comprising:

a feedback control system, comprising:

an electromagnetic actuator comprising an electromagnet having a coil and an armature magnetically coupled to the coil, such armature being coupled to the valve to stroke the valve between an open and closed position in response to a drive signal fed to the coil;

a feedforward controller, wherein the feedback control produces an error signal as a function of a difference between a predetermined desired position trajectory for the armature for each stroke of the armature and the actual position trajectory of the armature during such stroke, such error signal being used to produce a feedforward command signal to the feedforward controller, such feedforward controller to produce the drive signal to the coil during a subsequent stroke; and wherein the response of the feedforward controller to the error signal in providing the drive signal is based on the relationship between a change in armature position in response to a change in the drive signal, said feedback control is employed during the initial portion of a stroke.

13. The system as recited in claim 12 wherein said stroke is one of an opening stroke and a closing stroke.

14. The system as recited in claim 12 wherein said initial portion comprises approximately the 6 percent of said stroke.

15. The system as recited in claim 12 wherein said signal is based on the inverse of a function relating the position of the armature to drive signal to the armature.

* * * * *